US009666994B2

(12) United States Patent
Hwang

(10) Patent No.: US 9,666,994 B2
(45) Date of Patent: May 30, 2017

(54) DIRECT-CONNECT HIGH VOLTAGE CONNECTOR AND CONNECTION STRUCTURE THEREOF

(71) Applicant: HYUNDAI MOBIS Co., Ltd., Seoul (KR)

(72) Inventor: Jun Ha Hwang, Yongin-si (KR)

(73) Assignee: Hyundai Mobis Co., Ltd., Seoul (KR)

( * ) Notice: Subject to any disclaimer, the term of this patent is extended or adjusted under 35 U.S.C. 154(b) by 0 days.

(21) Appl. No.: 14/936,140

(22) Filed: Nov. 9, 2015

(65) Prior Publication Data

US 2016/0134060 A1 May 12, 2016

(30) Foreign Application Priority Data

Nov. 10, 2014 (KR) ..... 10-2014-0155432

(51) Int. Cl.
*H01R 13/6581* (2011.01)
*H01R 4/30* (2006.01)
*H01R 13/53* (2006.01)

(52) U.S. Cl.
CPC ..... *H01R 13/6581* (2013.01); *H01R 4/30* (2013.01); *H01R 13/53* (2013.01)

(58) Field of Classification Search
USPC ..... 439/587, 271, 262, 213, 263
See application file for complete search history.

(56) References Cited

U.S. PATENT DOCUMENTS 6,905,375 B2 * 6/2005 Ikeda ..... H01R 4/30 439/801
7,722,372 B2 * 5/2010 Matsumoto ..... H01R 13/42 174/68.2
7,985,092 B2 * 7/2011 Suzuki ..... H01R 13/193 439/346
8,500,475 B2 * 8/2013 Takehara ..... H01R 4/305 174/88 B
8,523,587 B2 * 9/2013 Suzuki ..... B60L 11/1803 439/262
8,678,842 B2 * 3/2014 Adachi ..... H01R 13/4361 439/263
8,734,173 B2 * 5/2014 Suzuki ..... H01R 13/193 439/262
8,951,065 B2 * 2/2015 Tsuge ..... H01R 13/631 439/559
9,112,397 B2 * 8/2015 Kobayashi ..... H01R 9/24
9,343,941 B2 * 5/2016 Okamoto ..... H01R 13/5202
2007/0218747 A1 * 9/2007 Takehara ..... H01R 13/5219 439/382
2012/0184123 A1 * 7/2012 Fukuda ..... H01R 13/639 439/271

* cited by examiner

*Primary Examiner* — Alexander Gilman
(74) *Attorney, Agent, or Firm* — NSIP Law

(57) ABSTRACT

Provided is a direct-connect high voltage connector and a connection structure thereof, which have at least one of a shield function and a waterproofing function and direct-connect a connector to a connection target element (an inverter and/or the like) through a bus bar. The direct-connect high voltage connector include a housing, a bus bar including one end, inserted into the housing through the other end of the housing and connected to a high-voltage cable, and the other end protruding to outside the housing, and a shield part disposed in the housing to surround the high-voltage cable. The high-voltage cable is inserted into the housing through one end of the housing.

14 Claims, 2 Drawing Sheets

1 - 1

I - I

DIRECT-CONNECT HIGH VOLTAGE CONNECTOR AND CONNECTION STRUCTURE THEREOF

CROSS-REFERENCE TO RELATED APPLICATIONS

This application claims priority under 35 U.S.C. §119 to Korean Patent Application No. 10-2014-0155432, filed on Nov. 10, 2014, the disclosure of which is incorporated herein by reference in its entirety.

TECHNICAL FIELD

The present invention relates to a direct-connect high voltage connector and a connection structure thereof, and more particularly, to a direct-connect high voltage connector and a connection structure thereof, which enable a connection target element (an inverter) to be direct-connected to a bus bar.

BACKGROUND

An inverter of a hybrid vehicle or an electric vehicle is a device that converts direct current (DC) power of a high-voltage battery into alternating current (AC) power for driving a motor.

A function of converting DC power into AC power is performed by a gate board controlling an insulated gate bipolar transistor (IGBT) switch included in the inverter according to a command of a control board.

Moreover, a connection part of the inverter and a battery is referred to as a high voltage input part, and a connection part of the inverter and the motor is referred to as a high voltage output part.

In a female-male connector connection method, a female connector and a male connector are connected to each other by a cable that is configured with a high-voltage connector.

In the female-male connector connection method, when the female connector is connected to the male connector, two the connectors are connected to each other by connecting a female terminal to a male terminal. When a contact area between the female terminal and the male terminal is maintained as a certain size or more, a flow of electricity is stable.

Moreover, in a method of connecting the female connector to the male connector, a capacity of a high-voltage connector is determined based on an amount of current flowing in the cable, and as the current increases, a size and weight of the high-voltage connector increase.

In a bus bar direct-connection method, one bus bar is fastened to another bus bar by a bolt.

A size of each of the bus bars is determined based on an amount of current flowing in the cable, and when the battery, the inverter, and the motor are implemented as one body or are disposed at a short distance, the high-voltage connector is usefully used.

Since the one bus bar is directly fastened to the other bus bar, a contact area between the bus bars is large and is useful for an internal performance of a vehicle and a vehicle environment such as vibration and the like.

However, in the above-described method of connecting the female connector to the male connector, since the female terminal and the male terminal should be large in order for a high current to flow, a size of a connector increases, and the contact area between the female terminal and the male terminal should satisfy a certain size at an actual vehicle environment at which vibration and the like occur.

Due to such limitations, a bus bar direct-connection method is mainly used for a high-current connection.

In the above-described direct-connection method, assembly is difficult because a bolt connection is required in assembling parts of a vehicle, and separate measures are needed for a waterproofing function and an electric shield function of each of the high voltage input part and the high voltage output part.

SUMMARY

Accordingly, the present invention provides a direct-connect high voltage connector and a connection structure thereof, which has a small size, easy assemblability, a shield function, and a waterproofing function.

In one general aspect, a direct-connect high voltage connector includes: a housing, a high-voltage cable being inserted into the housing through one end of the housing; a bus bar including one end, inserted into the housing through the other end of the housing and connected to the high-voltage cable, and the other end protruding to outside the housing; and a shield part disposed in the housing to surround the high-voltage cable.

The housing may be formed of a synthetic resin, and the shield part may include: a shield terminal coupled to the high-voltage cable; and a shield plate including one end connected to the shield terminal and the other end exposed to the other end of the housing.

The shield plate may be formed in a hollow shape, and the high-voltage cable and the bus bar may be connected to each other inside the shield plate. A ground part, which is bent and contacts a connection target element formed of metal and exposed to an outside in contact with the other end of the housing, may be provided in the other end of the shield plate.

The ground part may be bent in a direction toward an outer side of the shield plate.

The housing may further include a first sealing member configured to seal a space between the high-voltage cable and the housing.

The first sealing member may be formed in a hollow shape, and an inner circumference surface of the first sealing member may be closely adhered to the high-voltage cable to surround an outer portion of the high-voltage cable. A side surface of the first sealing member may be closely adhered to the housing.

The direct-connect high voltage connector may further including a second sealing member coupled to the other end of the housing to have a hollow shape, wherein the shield part and the bus bar may be disposed in the second sealing member.

The bus bar may be bolt-fastened to a connection bus bar included in the connection target element.

A fastening piece may be provided to protrude at each of the both ends of the housing, and the fastening piece may be bolt-fastened to the connection target element.

In another general aspect, a connection structure of a direct-connect high voltage connector includes: a connector coupled to a high-voltage cable; and a connection target element connected to the connector, wherein the connector includes: a housing, the high-voltage cable being inserted into the housing through one end of the housing; a bus bar including one end, inserted into the housing through the other end of the housing and connected to the high-voltage cable, and the other end protruding to outside the housing; and a shield part disposed in the housing to surround the high-voltage cable, the housing is closely adhered to the connection target element, and the bus bar is bolt-fastened to a connection bus bar provided in the connection target element, inside the connection target element.

The housing may be formed of a synthetic resin, and the shield part may include one end connected to the high-voltage cable and the other connected to the connection target element formed of metal.

A fastening piece may be provided to protrude at each of the both ends of the housing, and the fastening piece may be bolt-fastened to the connection target element. When the fastening piece is bolt-fastened to the connection target element, the other end of the shield part may be connected to the connection target element formed of metal.

The connector may further include: a first sealing member disposed in the housing to seal a space between the high-voltage cable and the housing; and a second sealing member coupled to the other end of the housing to seal a space between the other end of the housing and the connection target element. The bus bar and the shield part may be disposed in the second sealing member.

Other features and aspects will be apparent from the following detailed description, the drawings, and the claims.

DETAILED DESCRIPTION OF EMBODIMENTS

Hereinafter, embodiments of the present invention will be described in detail with reference to the accompanying drawings.

Figure 1:
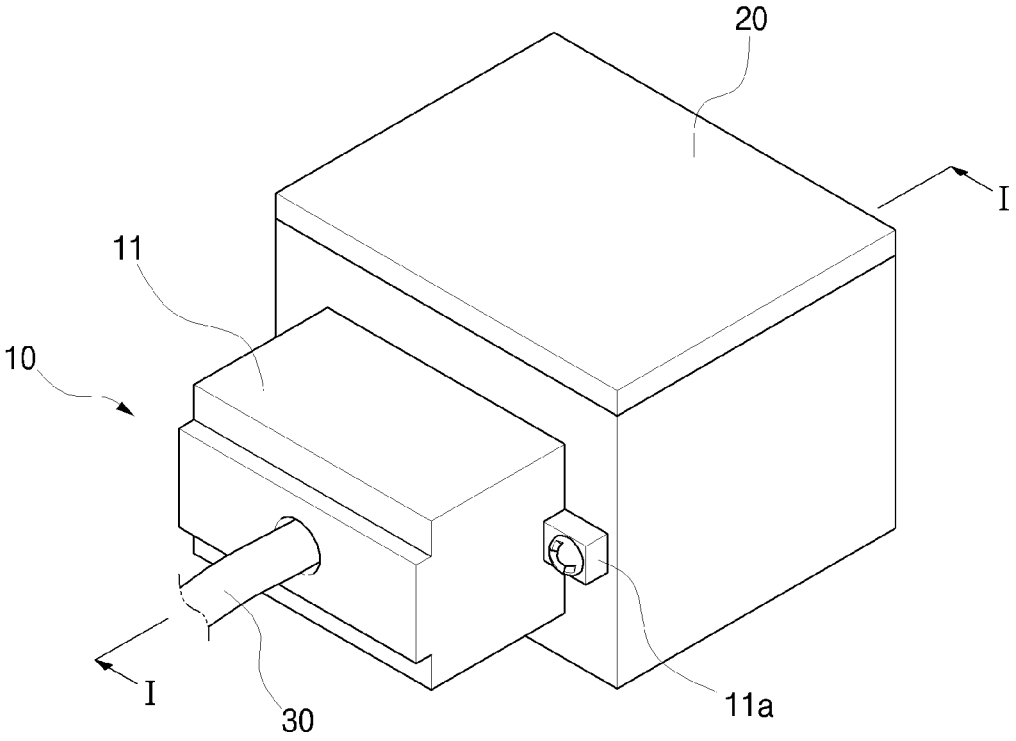
FIG. 1 is a perspective view illustrating a direct-connect high voltage connector according to an embodiment of the present invention.
Figure 2:
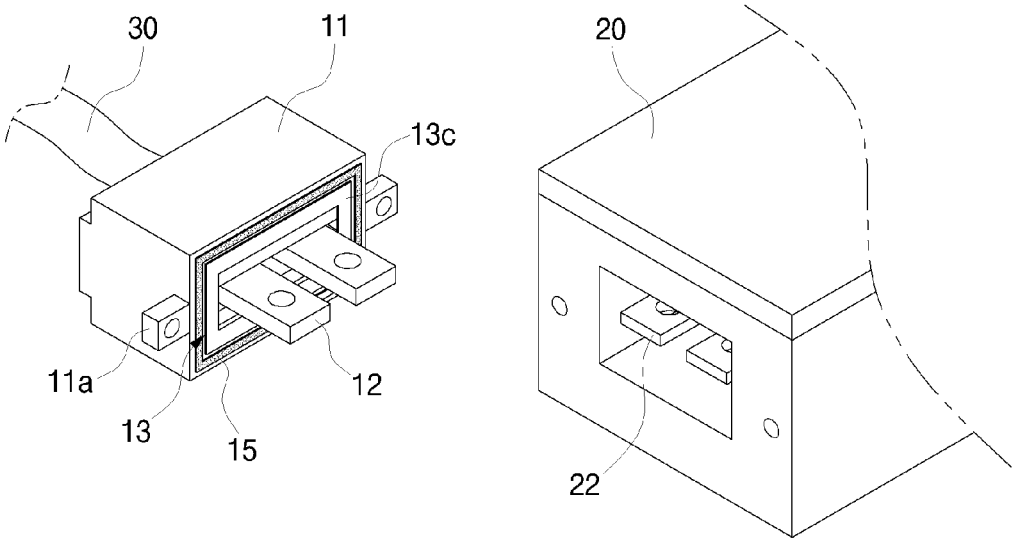
FIG. 2 is an exploded perspective view of the direct-connect high voltage connector according to an embodiment of the present invention.
Figure 3:
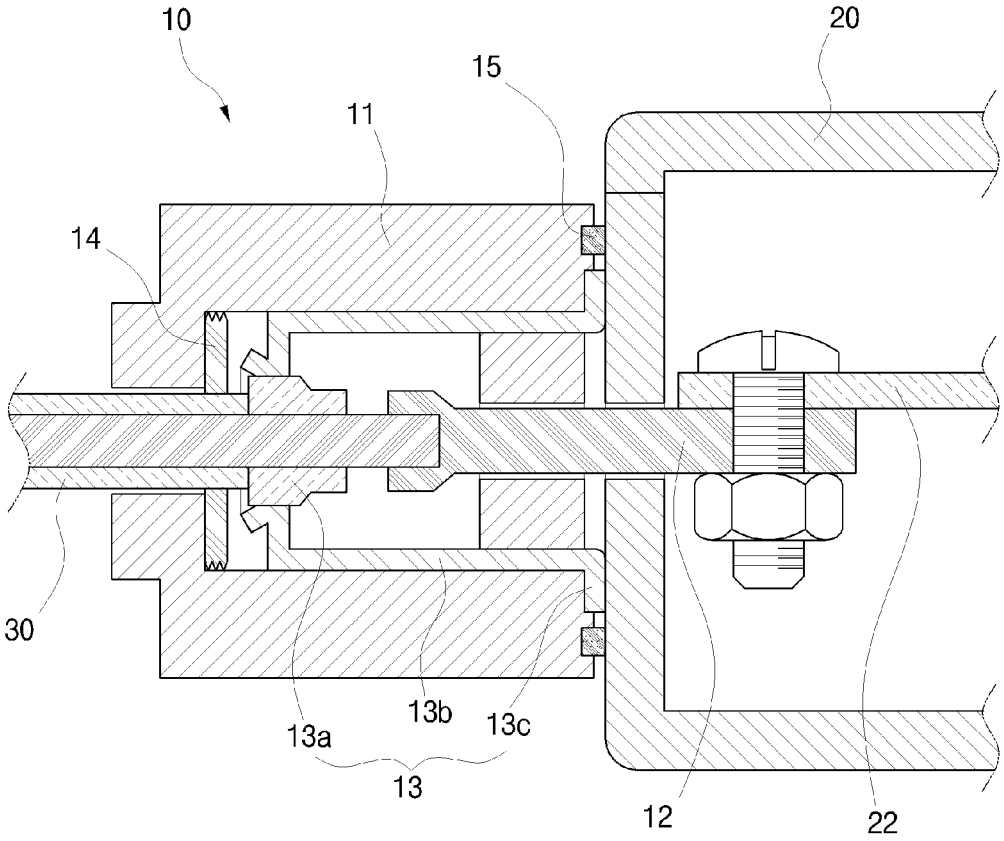
FIG. 3 is a cross-sectional view taken along line I-I of FIG. 1.

FIG. 1 is a perspective view illustrating a direct-connect high voltage connector 10 according to an embodiment of the present invention. FIG. 2 is an exploded perspective view of the direct-connect high voltage connector 10 according to an embodiment of the present invention. FIG. 3 is a cross-sectional view taken along line I-I of FIG. 1.

As illustrated in FIGS. 1 to 3, a connection structure of the direct-connect high voltage connector 10 according to an embodiment of the present invention may include a connector 10 and a connection target element 20.

The connector 10 may be coupled to a high-voltage cable 30.

The connection target element 20 may be connected to the connector 10 and may be configured with an inverter.

The connector 10 may include a housing 11, a bus bar 12, a shield part 13, a first sealing member 14, and a second sealing member 15.

The housing 11 may be approximately hexahedral in shape. Also, an empty space may be provided in the housing 11.

The housing 11 may be divided into a plurality of parts, which may be provided as one body through a connection.

The housing 11 may be formed of a nonconductive material such as a synthetic resin and/or the like.

The high-voltage cable 30 may be inserted into the housing 11 through one end of the housing 11.

One end of the bus bar 12 may be inserted into the housing 11 through the other end of the housing 11, and the other end may protrude to outside the housing 11.

The shield part 13 may be disposed in the empty space of the housing 11 to surround the high-voltage cable 30.

The shield part 13 may include a shield terminal 13*a* and a shield plate 13*b*.

The shield terminal 13*a* may be formed in a ring shape and may be coupled to a core of the high-voltage cable 30.

One end of the shield plate 13*b* may be connected to the shield terminal 13*a*, and the other end may be exposed to the other end of the housing 11.

The shield plate 13*b* may be formed in a hollow shape and may be spaced apart from the high-voltage cable 30 and the bus bar 12.

The high-voltage cable 30 may be connected to the bus bar 12, inside the shield plate 13*b*.

Moreover, the other end of the shield plate 13*b* may include a ground part 13*c* that is bent in a direction toward an outer side of the shield plate 13*b*.

The ground part 13*c* may be exposed to the outside in contact with the other end of the housing 11 and may contact the connection target element 20 formed of metal.

In more detail, when the housing 11 is closely adhered to the connection target element 20, the ground part 13*c* may contact a case of the connection target element 20 formed of metal.

With the housing 11 being closely adhered to the connection target element 20, the bus bar 12 may be bolt-fastened to a connection bus bar 22 provided in the connection target element 20.

The first sealing member 14 may be disposed in the housing 11 to seal a space between the high-voltage cable 30 and the housing 11.

The first sealing member 14 may be formed in a hollow shape like an O-ring, and an inter circumference surface of the first sealing member 14 may be closely adhered to an outer portion of the high-voltage cable 30.

Moreover, a side surface of the first sealing member 14 may be closely adhered to the housing 11.

Therefore, the first sealing member 14 may be closely adhered to the high-voltage cable 30 and the housing 11 to perform a sealing function of preventing liquid and/or the like from flowing into therebetween.

The second sealing member 15 may be formed in a hollow shape and may be coupled to the other end of the housing 11.

The second sealing member 15 may be disposed outside the shield part 13 and the bus bar 12, and thus, the shield part 13 and the bus bar 12 may be disposed inside the second sealing member 15.

The second sealing member 15 may seal a space between the other end of the housing 11 and the connection target element 20.

Moreover, a fastening piece 11*a* may be protrusion-formed at each of both ends of the housing 11 and may be bolt-fastened to the connection target element 20.

When the fastening piece 11*a* is bolt-fastened to the connection target element 20, the other end of the shield part 13 may be closely adhered to the connection target element 20 formed of metal, and the other end of the shield part 13 may be connected to the connection target element 20.

Hereinafter, a connection method between the connector 10 and the connection target element 20 will be described.

The connector 10 from which the bus bar 12 protrudes may contact an outer surface of the connection target element 20, and the bus bar 12 may be inserted into the connection target element 20.

In this state, the connection target element 20 may be bolt-coupled to the connector 10 by using the fastening piece 11*a*.

The ground part 13*c* may be closely adhered to the connection target element 20 formed of metal according to the connector 10 being bolt-coupled to the connection target element 20 through the fastening piece 11*a*, and the other end of the shield part 13 may be connected to the connection target element 20.

Moreover, the second sealing member 15 may be closely adhered to the connection target element 20 to seal a space between the other end of the housing 11 and the connection target element 20.

As described above, when the connector 10 is coupled to the connection target element 20 through the fastening piece 11*a*, a cover (not shown) provided in the connection target element 20 may be opened, and then, the bus bar 12 may be connected to the connection bus bar 22 through bolt-fastening.

The present invention may be applied to a high voltage output side as well as a high voltage input side.

Due to the above-described connection structure, a size of the connector 10 is reduced, and assembly is easily performed. Also, the connector 10 has a shield function and a waterproofing function.

As described above, according to the embodiments of the present invention, in comparison with a female-male connector connection structure of the related art, a size of the direct-connect high voltage connector is smaller, and thus, weight is reduced. Accordingly, a fuel efficiency of a vehicle is enhanced, and environment performance such as vibration is better in actual vehicles.

Moreover, according to the embodiments of the present invention, since a connector has the shield function and the waterproofing function, internal parts of a connection target element (i.e., the inverter) are reduced, and a structure of the connection target element (i.e., the inverter) is simplified. Accordingly, in comparison with a bus bar direct-connection method of the related art, an assembly process of the inverter is simplified.

Moreover, according to the embodiments of the present invention, since the separate shield part is used, a housing of a connector may be formed of a synthetic resin, and thus, weight of the connector is reduced.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A direct-connect high voltage connector comprising:
- a housing;
- a high-voltage cable disposed in the housing through one end of the housing;
- a bus bar comprising:
  - one end of the bus bar disposed in the housing through another end of the housing and connected to the high-voltage cable, and
  - another end of the bus bar protruding outside the housing; and
- a shield part disposed in the housing to surround the high-voltage cable, wherein the shield part comprises a ground part exposed to an outside of the housing and in contact with the other end of the housing.

2. The direct-connect high voltage connector of claim 1, wherein:
- the housing is formed of a synthetic resin;
- the shield part comprises a shield terminal coupled to a core of the high-voltage cable; and
- a shield plate comprising one end connected to the shield terminal and another end exposed to the other end of the housing.

3. The direct-connect high voltage connector of claim 2, wherein:
- the shield plate is formed in a hollow shape;
- the high-voltage cable and the bus bar are connected to each other inside the shield plate; and
- the ground part is bent, contacts a connection target element formed of metal, and is provided in the other end of the shield plate.

4. The direct-connect high voltage connector of claim 3, wherein the ground part is bent in a direction toward an outer side of the shield plate.

5. The direct-connect high voltage connector of claim 1, wherein the housing further comprises a first sealing member configured to seal a space between the high-voltage cable and the housing.

6. The direct-connect high voltage connector of claim 5, wherein:
- the first sealing member is formed in a hollow shape;
- an inner circumference surface of the first sealing member is closely adhered to the high-voltage cable and surrounds an outer portion of the high-voltage cable; and
- a side surface of the first sealing member is closely adhered to the housing.

7. The direct-connect high voltage connector of claim 1, further comprising a second sealing member coupled to the other end of the housing and having a hollow shape,
- wherein the shield part and the bus bar are disposed within an inner circumference of the second sealing member.

8. The direct-connect high voltage connector of claim 1, wherein the bus bar is bolt-fastened to a connection bus bar included in a connection target element.

9. The direct-connect high voltage connector of claim 1, wherein:
- a first fastening piece protrudes from one side of the housing;
- a second fastening piece protrudes from another side of the housing; and
- the fastening piece is bolt-fastened to a connection target element.

10. A connection structure of a direct-connect high voltage connector, the connection structure comprising:
- a connector coupled to a high-voltage cable; and
- a connection target element connected to the connector,
- wherein the connector comprises:
  - a housing;
  - the high-voltage cable disposed within the housing through one end of the housing;
  - a bus bar comprising one end of the bus bar, disposed within the housing through another end of the housing and connected to the high-voltage cable, and another end of the bus bar protruding outside the housing; and
  - a shield part disposed in the housing to surround the high-voltage cable,
- wherein the shield part comprises a ground part exposed to an outside of the housing and in contact with the other end of the housing, wherein the housing is closely adhered to the connection target element, and wherein the bus bar is bolt-fastened, within the connection target element, to a connection bus bar disposed within the connection target element.

11. The connection structure of claim 10, wherein:

the housing is formed of a synthetic resin;

the shield part comprises one end connected to the high-voltage cable and another end connected to the connection target element; and the connection target element is formed of metal.

12. The connection structure of claim 11, wherein:

a first fastening piece protrudes from one side of the housing;

a second fastening piece protrudes from another side of the housing;

the fastening piece is bolt-fastened to the connection target element; and when the fastening piece is bolt-fastened to the connection target element, the other end of the shield part is connected to the connection target element formed of metal.

13. The connection structure of claim 10, wherein:

the connector further comprises:

a first sealing member disposed in the housing to seal a space between the high-voltage cable and the housing; and a second sealing member coupled to the other end of the housing to seal a space between the other end of the housing and the connection target element, and the bus bar and the shield part are disposed within an inner circumference of the second sealing member.

14. A direct-connect high voltage connector comprising:

a housing;

a high-voltage cable disposed within the housing through one end of the housing;

a bus bar comprising:

one end of the bus bar disposed within the housing through another end of the housing and connected to the high-voltage cable, and another end of the bus bar protruding outside the housing; and a shield plate disposed in the housing to surround the high-voltage cable and comprising a ground part disposed outside of the housing at the other end of the housing.

* * * * *